US009676083B2

(12) United States Patent
Johnson et al.

(10) Patent No.: US 9,676,083 B2
(45) **Date of Patent: *Jun. 13, 2017**

(54) DUAL PURPOSE FLIP-OUT AND T HANDLE

(71) Applicant: WAGIC, Inc., Los Gatos, CA (US)

(72) Inventors: Ronald L. Johnson, San Jose, CA (US); Yugen Patrick Lockhart, Palo Alto, CA (US)

(73) Assignee: WAGIC, INC., San Jose, CA (US)

( * ) Notice: Subject to any disclaimer, the term of this patent is extended or adjusted under 35 U.S.C. 154(b) by 248 days.

This patent is subject to a terminal disclaimer.

(21) Appl. No.: 14/094,117

(22) Filed: Dec. 2, 2013

(65) Prior Publication Data

US 2014/0083258 A1 Mar. 27, 2014

Related U.S. Application Data

(63) Continuation of application No. 12/573,719, filed on Oct. 5, 2009, now Pat. No. 8,621,963.

(51) Int. Cl.

| | |
|---|---|
| ***B25B 13/46*** | (2006.01) |
| ***B25B 23/16*** | (2006.01) |
| ***B25G 3/38*** | (2006.01) |
| ***B25G 1/06*** | (2006.01) |

(52) U.S. Cl.

CPC ..... *B25B 13/461* (2013.01); *B25B 23/16* (2013.01); *B25G 1/063* (2013.01); *B25G 3/38* (2013.01); *Y10T 29/49826* (2015.01)

(58) Field of Classification Search

CPC ..... B25B 13/44; B25B 13/46; B25B 13/461; B25B 23/0042; B25B 23/16; B25G 1/043; B25G 1/063; B25G 3/38; Y10T 29/49826

USPC ..... 81/177.6, 177.5, 177.7, 177.8

See application file for complete search history.

(56) References Cited

U.S. PATENT DOCUMENTS

| | | | | |
|---|---|---|---|---|
| 244,309 | A | 7/1881 | Rhodes | |
| 363,331 | A | 5/1887 | Hammer | |
| 364,422 | A | 6/1887 | Laforge | |
| 580,235 | A | 4/1897 | Strum | |
| 647,528 | A | 4/1900 | Schmidt | |
| 655,007 | A | 7/1900 | Rairigh | |
| 763,745 | A | 6/1904 | Gheen | |
| 776,761 | A * | 12/1904 | Sampson | B25B 13/481 81/120 |
| 873,363 | A | 12/1907 | Ross | |
| 875,493 | A | 12/1907 | Beard | |
| 890,150 | A | 6/1908 | Marble | |

(Continued)

FOREIGN PATENT DOCUMENTS

| | | |
|---|---|---|
| CA | 1147176 | 5/1983 |
| CA | 1232781 A | 2/1988 |

(Continued)

*Primary Examiner* — Hadi Shakeri

(74) *Attorney, Agent, or Firm* — Haverstock & Owens LLP

(57) ABSTRACT

A dual purpose flip-out and T handle ratchet is able to be used in an L or modified L-handle orientation as well as a T handle orientation. The dual purpose flip-out and T handle includes a handle portion and a ratchet head and neck portion. The handle portion is coupled to the neck portion at a lockable hinge. The hinge allows the head and neck portion to rotate to an L or modified L-handle orientation or to a T handle orientation. When properly oriented the tool is able to be used to tighten or loosen objects such as screws or bolts.

16 Claims, 9 Drawing Sheets

(56) References Cited

U.S. PATENT DOCUMENTS

| | | | |
|---|---|---|---|
| 959,408 | A | 5/1910 | Volbert |
| 1,000,900 | A | 8/1911 | Dorsey |
| 1,006,679 | A | 10/1911 | Rice |
| 1,100,070 | A | 6/1914 | Graham |
| 1,172,656 | A | 2/1916 | Yorgensen |
| 1,187,842 | A | 6/1916 | Kaas |
| D53,597 | S | 7/1919 | Marcmann |
| 1,398,583 | A | 11/1921 | Bovee |
| 1,425,270 | A | 8/1922 | Morgan |
| 1,500,852 | A | 7/1924 | Shepard |
| 1,502,044 | A | 7/1924 | McCann |
| 1,530,905 | A | 3/1925 | Nance |
| 1,559,097 | A | 10/1925 | Hill |
| 1,699,020 | A | 1/1929 | Raleigh |
| 1,753,026 | A | 4/1930 | Rosati |
| 1,825,936 | A | 6/1931 | Bodmer |
| 1,888,222 | A | 11/1932 | Curtis et al. |
| 1,915,245 | A | 6/1933 | Cook |
| 1,940,606 | A | 1/1934 | Little |
| 1,970,409 | A | 8/1934 | Wiedermann |
| 2,236,333 | A | 3/1941 | Cowies |
| 2,332,656 | A | 10/1943 | Mirando |
| 2,346,364 | A | 4/1944 | Dowe |
| D142,982 | S | 11/1945 | Bloomfield |
| 2,409,613 | A | 10/1946 | Brooks |
| 2,410,971 | A | 11/1946 | Hartley |
| 2,465,152 | A | 3/1949 | Ellison |
| 2,465,619 | A | 3/1949 | Veit |
| 2,475,268 | A | 7/1949 | Wittle |
| 2,485,991 | A | 10/1949 | Stowell |
| D156,677 | S | 12/1949 | Smith |
| D157,154 | S | 2/1950 | Horton |
| 2,509,507 | A | 5/1950 | Kane |
| 2,512,967 | A | 6/1950 | Quiron |
| 2,530,024 | A | 11/1950 | Moody |
| 2,532,636 | A | 12/1950 | Minnich |
| 2,569,069 | A | 9/1951 | Motel |
| 2,590,307 | A | 3/1952 | Gibson |
| 2,593,828 | A | 4/1952 | Arey |
| 2,604,211 | A | 7/1952 | Steine |
| 2,701,052 | A | 2/1955 | Martel |
| D175,056 | S | 6/1955 | Wilson |
| 2,715,028 | A | 8/1955 | Dossie |
| 2,719,042 | A | 9/1955 | Epsy |
| 2,726,091 | A | 12/1955 | Topar |
| 2,776,589 | A | 1/1957 | Gregory |
| 2,778,396 | A | 1/1957 | Swain |
| D179,979 | S | 4/1957 | Noga |
| 2,797,599 | A | 7/1957 | Mcgarvie, Jr. |
| 2,800,816 | A | 7/1957 | Tasciotti |
| 2,804,970 | A | 9/1957 | Kuc et al. |
| 2,810,472 | A | 10/1957 | Midkiff |
| 2,836,210 | A | 5/1958 | Garofalo |
| 2,842,020 | A | 7/1958 | Traquino |
| 2,844,244 | A | 7/1958 | Hanson |
| 2,851,915 | A | 9/1958 | Martinez |
| 2,854,741 | A | 10/1958 | Cholger |
| 2,878,701 | A | 3/1959 | Weersma |
| 3,023,054 | A | 2/1962 | Shigekuni |
| 3,061,927 | A | 11/1962 | Von Frakenberg Und Ludwingdorf |
| 3,113,479 | A | 12/1963 | Swingle |
| 3,156,143 | A | 11/1964 | Wolf |
| 3,222,959 | A | 12/1965 | Clark |
| 3,255,792 | A | 6/1966 | Beck |
| 3,257,991 | A | 6/1966 | Mosch |
| D205,745 | S | 9/1966 | Nannfeldt |
| 3,342,229 | A | 9/1967 | Janes |
| 3,343,434 | A | 9/1967 | Schroeder |
| 3,370,696 | A | 2/1968 | Dembicks |
| 3,424,039 | A | 1/1969 | Scott |
| 3,592,086 | A | 7/1971 | Derwin |
| 3,654,975 | A | 4/1972 | Ballsmith et al. |
| 3,667,518 | A | 6/1972 | Stillwagon, Jr. |
| 3,707,893 | A | 1/1973 | Hofman |
| 3,733,936 | A | 5/1973 | Flynn |
| 3,802,286 | A | 4/1974 | Winklhofer et al. |
| 3,863,693 | A | 2/1975 | Carriker |
| 3,943,801 | A | 3/1976 | Yates |
| 3,958,469 | A | 5/1976 | Meese |
| 3,997,053 | A | 12/1976 | Bondhus |
| 4,000,767 | A | 1/1977 | Geng |
| 4,043,230 | A | 8/1977 | Scrivens |
| 4,124,915 | A | 11/1978 | Schlicher |
| 4,154,125 | A | 5/1979 | Frank |
| 4,196,761 | A | 4/1980 | Royer |
| 4,227,430 | A | 10/1980 | Jansson |
| 4,235,269 | A | 11/1980 | Kraus |
| 4,238,862 | A | 12/1980 | Leatherman |
| 4,241,773 | A | 12/1980 | Personnat |
| 4,302,990 | A | 12/1981 | Chrichton et al. |
| 4,308,770 | A | 1/1982 | Macdonald |
| 4,310,094 | A | 1/1982 | Hotchkiss |
| 4,327,790 | A | 5/1982 | Stevens et al. |
| 4,384,499 | A | 5/1983 | Shockley |
| D270,024 | S | 8/1983 | Strasser |
| 4,424,728 | A | 1/1984 | Macdonald |
| 4,448,097 | A | 5/1984 | Rocca |
| 4,469,109 | A | 9/1984 | Mehl |
| 4,476,751 | A | 10/1984 | Mishima |
| 4,525,889 | A | 7/1985 | Dunau |
| 4,542,667 | A | 9/1985 | Jang |
| D284,810 | S | 7/1986 | Kelemen, Sr. |
| 4,598,822 | A | 7/1986 | Hemmings |
| 4,621,718 | A | 11/1986 | Decarolis |
| 4,640,155 | A | 2/1987 | Condon |
| 4,667,822 | A | 5/1987 | Coopmans |
| 4,699,020 | A | 10/1987 | Bush et al. |
| 4,699,030 | A | 10/1987 | Yang |
| 4,703,673 | A | 11/1987 | Allen |
| 4,711,353 | A | 12/1987 | Rozmestor |
| 4,715,346 | A | 12/1987 | Dempsey |
| 4,716,795 | A | 1/1988 | Corona et al. |
| 4,716,796 | A | 1/1988 | Corona et al. |
| 4,767,006 | A | 8/1988 | Wasem |
| 4,783,867 | A | 11/1988 | Tsao |
| 4,787,276 | A | 11/1988 | Condon |
| 4,815,346 | A | 3/1989 | Littlehorn |
| 4,819,523 | A | 4/1989 | Souza |
| 4,819,800 | A | 4/1989 | Wilson |
| 4,820,090 | A | 4/1989 | Chen |
| D302,102 | S | 7/1989 | Amagaya |
| 4,882,841 | A | 11/1989 | Margolis |
| 4,922,569 | A | 5/1990 | Brinker et al. |
| 4,926,721 | A | 5/1990 | Hsiao |
| D308,462 | S | 6/1990 | Komatsu |
| 4,934,223 | A | 6/1990 | Wong |
| D310,770 | S | 9/1990 | Zamarripa |
| D311,124 | S | 10/1990 | Learney |
| 4,960,016 | A | 10/1990 | Seals |
| 4,974,477 | A | 12/1990 | Anderson |
| 4,979,407 | A | 12/1990 | Hernandez et al. |
| 5,029,707 | A | 7/1991 | Feng |
| 5,036,975 | A | 8/1991 | Chow |
| 5,042,658 | A | 8/1991 | Tiramani et al. |
| 5,062,173 | A | 11/1991 | Collins et al. |
| 5,063,796 | A | 11/1991 | Gennep |
| 5,065,487 | A | 11/1991 | Yother |
| 5,086,674 | A | 2/1992 | Her |
| 5,146,815 | A | 9/1992 | Scott, III |
| 5,147,038 | A | 9/1992 | Pergeau |
| D333,769 | S | 3/1993 | Jureckson |
| D334,516 | S | 4/1993 | Tsunoda |
| D339,048 | S | 9/1993 | Baum |
| 5,251,352 | A | 10/1993 | Cullison |
| 5,263,389 | A | 11/1993 | Frazzell et al. |
| 5,265,504 | A | 11/1993 | Fruhm |
| D342,433 | S | 12/1993 | Sorenson |
| 5,271,300 | A | 12/1993 | Zurbuchen et al. |
| D343,106 | S | 1/1994 | Eklind et al. |
| 5,295,422 | A | 3/1994 | Chow |
| 5,320,004 | A | 6/1994 | Hsiao |
| 5,394,984 | A | 3/1995 | Aiba |
| D359,671 | S | 6/1995 | Acosta |

(56) References Cited

U.S. PATENT DOCUMENTS 5,421,225 A 6/1995 Chen
5,450,774 A 9/1995 Chang
5,461,950 A 10/1995 Iwinski
D365,681 S 1/1996 Chow
5,480,166 A 1/1996 Milsop
5,495,942 A 3/1996 Izhak
5,499,560 A 3/1996 Aeschliman
5,499,562 A 3/1996 Feng
5,505,316 A 4/1996 Lee
5,517,885 A 5/1996 Feng
5,522,291 A 6/1996 Liu
5,535,882 A 7/1996 Liu
5,542,322 A 8/1996 Knox et al.
D373,943 S 9/1996 Fuhrmann
5,553,340 A 9/1996 Brown, Jr.
5,566,596 A 10/1996 Lin
D376,520 S 12/1996 Morin
5,581,834 A 12/1996 Collins
D377,444 S 1/1997 Lin
5,592,859 A 1/1997 Johnson et al.
D378,797 S 4/1997 Poremba et al.
5,630,342 A 5/1997 Owoc
D380,131 S 6/1997 Sung
D382,190 S 8/1997 Blackston et al.
5,653,525 A 8/1997 Park
D383,048 S 9/1997 Sorensen et al.
5,662,013 A 9/1997 Lin
D385,172 S 10/1997 Bramsiepe et al.
D386,955 S 12/1997 Jones et al.
5,692,659 A 12/1997 Reeves
D388,609 S 1/1998 Chan
5,711,042 A 1/1998 Chuang
5,711,194 A 1/1998 Anderson et al.
D394,792 S 6/1998 Bourque
D394,794 S 6/1998 Vasudeva
5,758,870 A 6/1998 Weaver
5,765,247 A 6/1998 Seber et al.
5,765,454 A 6/1998 Barbulescu et al.
5,768,960 A 6/1998 Archuleta
5,791,211 A 8/1998 Bondhus et al.
5,802,936 A 9/1998 Liu
5,803,584 A 9/1998 Chung
5,816,401 A 10/1998 Vasudeva et al.
5,820,288 A 10/1998 Cole
5,822,830 A 10/1998 Lin
D400,775 S 11/1998 Hsu
5,855,274 A 1/1999 Piao
D405,335 S 2/1999 Lin
D408,253 S 4/1999 Rowlay
5,911,799 A 6/1999 Johnson et al.
5,916,277 A 6/1999 Dallas
5,916,341 A 6/1999 Lin
5,918,513 A 7/1999 Ho
5,918,741 A 7/1999 Vasudeva
5,938,028 A 8/1999 Hu
5,970,828 A 10/1999 Bondhus et al.
D415,946 S 11/1999 Tsai
5,983,759 A 11/1999 Turner
5,992,626 A 11/1999 Anderson
D418,731 S 1/2000 Rowlay et al.
D420,885 S 2/2000 Lin
6,032,332 A 3/2000 Lin
6,032,796 A 3/2000 Hopper et al.
1,337,769 A 4/2000 Hemming
6,044,973 A 4/2000 Vasudeva
D426,449 S 6/2000 Eklind
D426,450 S 6/2000 Eklind
D427,875 S 7/2000 Chiu
6,085,620 A 7/2000 Anderson et al.
6,088,861 A 7/2000 Sessions et al.
6,089,133 A 7/2000 Liao
6,092,656 A 7/2000 Ernst
6,095,018 A 8/2000 Schuster
6,105,767 A 8/2000 Vasudeva
6,128,981 A 10/2000 Bondhus et al.
6,131,740 A 10/2000 Huang
D433,613 S 11/2000 Jialin
D433,910 S 11/2000 Oliver et al.
6,151,998 A 11/2000 Fu-Hui
D435,415 S 12/2000 Johnson et al.
6,164,172 A 12/2000 Huang
D435,773 S 1/2001 Lin
D437,541 S 2/2001 Hermansen et al.
D437,763 S 2/2001 Oliver et al.
6,186,785 B1 2/2001 Rogers et al.
6,202,864 B1 3/2001 Ernst et al.
6,206,189 B1 3/2001 Huot, Jr. et al.
D440,852 S 4/2001 Ernst
6,233,769 B1 5/2001 Seber et al.
6,237,451 B1 5/2001 Wei
6,257,106 B1 7/2001 Anderson et al.
6,260,453 B1 7/2001 Anderson et al.
6,279,434 B1 8/2001 Brown
6,279,435 B1 8/2001 Zayat, Jr.
6,289,768 B1 9/2001 Anderson et al.
6,295,903 B1 10/2001 Tipper et al.
6,305,248 B1 10/2001 Rowlay
6,308,599 B1 10/2001 Fu-Hui
6,311,587 B1 11/2001 Johnson et al.
6,314,600 B1 11/2001 Cachot
6,314,838 B2 11/2001 Wall
6,318,218 B1 11/2001 Anderson et al.
6,332,381 B1 12/2001 Vasudeva
6,345,557 B1 2/2002 Kuo
D454,766 S 3/2002 Lin
6,352,010 B1 3/2002 Giarritta et al.
6,357,068 B1 3/2002 Seber et al.
D455,630 S 4/2002 Chiu
6,371,290 B1 4/2002 Yearous et al.
6,378,402 B1 4/2002 Kalomeris et al.
6,382,057 B1 5/2002 Kienholz
6,389,931 B1 5/2002 Delaney et al.
6,397,709 B1 6/2002 Wall
6,401,576 B1 6/2002 Wu
6,401,923 B1 6/2002 Huang
6,405,620 B2 6/2002 Liao
D459,967 S 7/2002 Johnson et al.
D461,311 S 8/2002 Gharib
6,427,564 B1 8/2002 Nelson
6,490,954 B2 12/2002 Johnson et al.
6,510,767 B1 1/2003 Rivera
D470,739 S 2/2003 Chen
D472,712 S 4/2003 Sagen
D472,931 S 4/2003 Leins
6,564,680 B1 5/2003 Rinner et al.
6,598,503 B1 7/2003 Cunningham
6,601,481 B2 8/2003 Chuang
6,606,925 B1 8/2003 Gmeilbauer
D479,963 S 9/2003 Chang
6,634,502 B1 10/2003 Yu
6,640,675 B1 11/2003 Chuang
6,675,678 B2 1/2004 Liu
6,698,318 B2 3/2004 Peters
6,701,813 B2 3/2004 Hu
6,709,196 B1 3/2004 Medendorp
6,739,224 B1 5/2004 Wershe
6,751,819 B2 6/2004 Chuang
6,751,820 B1 6/2004 Wu
6,752,046 B1 6/2004 Lee
6,758,350 B2 7/2004 Lin
6,763,744 B2 7/2004 Johnson et al.
D494,438 S 8/2004 Falkenstein et al.
6,799,490 B1 10/2004 Chu
6,827,210 B2 12/2004 Chen
6,863,471 B2 3/2005 Medendorp
6,877,186 B2 4/2005 Shiao
6,898,998 B2 5/2005 Shyu
6,901,826 B2 6/2005 Huang
6,918,323 B2 7/2005 Arnold et al.
6,922,870 B2 8/2005 Tontz, Sr.
6,925,910 B2 8/2005 Alford
6,928,908 B1 8/2005 Yu
6,935,211 B2 8/2005 Chen
6,935,212 B2 8/2005 Wadsworth

(56) References Cited

U.S. PATENT DOCUMENTS

| | | | |
|---|---|---|---|
| 6,941,843 | B2 | 9/2005 | Johnson et al. |
| 6,948,406 | B1 | 9/2005 | Li |
| 6,968,758 | B2 | 11/2005 | Lin |
| 6,988,616 | B2 | 1/2006 | Chen |
| 7,028,593 | B1 | 4/2006 | Lin et al. |
| 7,047,847 | B2 | 5/2006 | Chuang |
| 7,051,626 | B1 | 5/2006 | Chen |
| 7,051,629 | B2 | 5/2006 | Huang |
| D523,637 | S | 6/2006 | Chang |
| 7,066,061 | B1 | 6/2006 | Chen et al. |
| 7,073,418 | B2 | 7/2006 | Kuo |
| 7,080,582 | B2 | 7/2006 | Karle |
| 7,086,314 | B2 | 8/2006 | Wannop |
| 7,093,519 | B1 | 8/2006 | Huang |
| D527,903 | S | 9/2006 | Chan |
| 7,100,476 | B1 | 9/2006 | Feit |
| 7,131,358 | B2 | 11/2006 | Hsien |
| 7,140,280 | B2 | 11/2006 | Hawkins et al. |
| 7,143,669 | B2 | 12/2006 | Hu |
| 7,150,208 | B2 | 12/2006 | Debley |
| 7,155,998 | B1 | 1/2007 | Shyu |
| 7,159,260 | B2 | 1/2007 | Hansen |
| 7,159,491 | B1 | 1/2007 | Chaconas et al. |
| 7,165,479 | B1 | 1/2007 | Lee |
| 7,168,345 | B1 | 1/2007 | Hsieh |
| 7,182,003 | B1 | 2/2007 | Hsieh |
| 7,185,565 | B1 | 3/2007 | Hu |
| 7,216,569 | B2 | 5/2007 | Abdelgany |
| 7,237,463 | B1 | 7/2007 | Lee |
| D548,464 | S | 8/2007 | Lin |
| 7,284,466 | B1 | 10/2007 | Ho |
| D557,099 | S | 12/2007 | Lin |
| 7,305,908 | B2 | 12/2007 | Chi |
| 7,406,896 | B2 | 8/2008 | Rivera |
| 7,409,894 | B1 | 8/2008 | Valentine |
| 7,415,745 | B2 | 8/2008 | Rivera |
| 7,467,574 | B1 | 12/2008 | Lin |
| 7,467,575 | B2 | 12/2008 | Lai |
| 7,565,852 | B2 | 7/2009 | Yu |
| 7,571,517 | B2 | 8/2009 | Smith et al. |
| 7,600,640 | B2 | 10/2009 | Hallee et al. |
| D604,509 | S | 11/2009 | Andrews |
| 7,698,972 | B2 | 4/2010 | Hi |
| 7,743,685 | B2 | 6/2010 | Chang |
| D622,125 | S | 8/2010 | Robinson |
| D623,037 | S | 9/2010 | Johnson et al. |
| 7,810,415 | B2 | 10/2010 | Adamany et al. |
| 7,815,058 | B2 | 10/2010 | Cheng |
| 7,836,534 | B2 | 11/2010 | Simmons |
| 7,846,203 | B2 | 12/2010 | Cribier |
| 7,946,203 | B2 | 5/2011 | Johnson et al. |
| 8,011,277 | B2 | 9/2011 | Johnson et al. |
| 8,015,642 | B1 | 9/2011 | Oakley |
| D650,257 | S | 12/2011 | Royes et al. |
| 8,336,428 | B2 | 12/2012 | Johnson et al. |
| 8,359,954 | B2 | 1/2013 | Johnson et al. |
| 8,468,916 | B2 | 6/2013 | Johnson et al. |
| 8,613,121 | B1 | 12/2013 | White |
| 8,640,574 | B2 | 2/2014 | Johnson et al. |
| 8,875,601 | B2 | 11/2014 | Johnson et al. |
| 8,925,429 | B2 | 1/2015 | Johnson et al. |
| 2001/0005576 | A1 | 6/2001 | Rogers et al. |
| 2001/0045145 | A1 | 11/2001 | Legg |
| 2003/0000902 | A1 | 1/2003 | Keis et al. |
| 2003/0047474 | A1 | 3/2003 | Dahlson |
| 2003/0126957 | A1 | 7/2003 | Huang |
| 2003/0136234 | A1 | 7/2003 | Cunningham |
| 2003/0188610 | A1 | 10/2003 | Lin |
| 2003/0226428 | A1 | 12/2003 | Liu |
| 2004/0050218 | A1 | 3/2004 | Napoli |
| 2004/0173061 | A1 | 9/2004 | Liou |
| 2004/0262344 | A1 | 12/2004 | White |
| 2005/0011318 | A1 | 1/2005 | Tsai |
| 2005/0199108 | A1 | 9/2005 | Jheng |
| 2005/0229752 | A1 | 10/2005 | Nickipuck |
| 2005/0247587 | A1 | 11/2005 | Holland-Letz |
| 2005/0268754 | A1 | 12/2005 | Fa |
| 2005/0284267 | A1 | 12/2005 | Liao |
| 2006/0042428 | A1 | 3/2006 | Chuang |
| 2006/0101955 | A1 | 5/2006 | Chang |
| 2006/0118500 | A1 | 6/2006 | Chen |
| 2006/0150784 | A1 | 7/2006 | Hsieh |
| 2006/0254396 | A1 | 11/2006 | Hu |
| 2006/0288531 | A1 | 12/2006 | Hu |
| 2006/0288823 | A1 | 12/2006 | Schepman |
| 2007/0023306 | A1 | 2/2007 | Lai |
| 2007/0044559 | A1 | 3/2007 | Andrews |
| 2007/0044598 | A1 | 3/2007 | Frohm et al. |
| 2007/0056117 | A1 | 3/2007 | Gardiner et al. |
| 2007/0056872 | A1 | 3/2007 | Begim |
| 2007/0062831 | A1 | 3/2007 | Chen |
| 2007/0084740 | A1 | 4/2007 | Malek |
| 2007/0141885 | A1 | 6/2007 | Chen |
| 2007/0151402 | A1 | 7/2007 | Scheerman et al. |
| 2007/0186731 | A1 | 8/2007 | Schnarr et al. |
| 2007/0221017 | A1 | 9/2007 | Heaven |
| 2007/0228672 | A1 | 10/2007 | Huang |
| 2007/0245862 | A1 | 10/2007 | Gonzalez et al. |
| 2007/0295171 | A1 | 12/2007 | Johnson et al. |
| 2008/0128370 | A1 | 6/2008 | Shih |
| 2008/0148909 | A1 | 6/2008 | Lai |
| 2008/0156754 | A1 | 7/2008 | Cheng |
| 2008/0164171 | A1 | 7/2008 | Meng |
| 2008/0190249 | A1 | 8/2008 | Yu |
| 2008/0202963 | A1 | 8/2008 | Liao |
| 2008/0223179 | A1 | 9/2008 | Nash et al. |
| 2008/0251402 | A1 | 10/2008 | Chiu |
| 2008/0256816 | A1 | 10/2008 | Cosentino |
| 2008/0271573 | A1 | 11/2008 | Lown et al. |
| 2008/0295657 | A1 | 12/2008 | Cluthe |
| 2009/0107303 | A1 | 4/2009 | Steinweg et al. |
| 2009/0183604 | A1 | 7/2009 | Johnson et al. |
| 2009/0183608 | A1 | 7/2009 | Johnson et al. |
| 2009/0183609 | A1 | 7/2009 | Johnson et al. |
| 2009/0241740 | A1 | 10/2009 | Heagerty |
| 2010/0258465 | A1 | 10/2010 | Gomas |
| 2011/0000024 | A1 | 1/2011 | Johnson et al. |
| 2011/0094910 | A1 | 4/2011 | Fleury et al. |
| 2012/0012485 | A1 | 1/2012 | Wang |
| 2013/0228484 | A1 | 9/2013 | Yang |

FOREIGN PATENT DOCUMENTS

| | | | |
|---|---|---|---|
| CN | 2628630 | Y | 7/2004 |
| DE | 464002 | | 8/1928 |
| DE | 2035793 | B1 | 3/1972 |
| DE | 2453480 | A | 5/1976 |
| DE | 3744176 | A1 | 8/1989 |
| DE | 102004011892 | | 1/2005 |
| DE | 202004013404 | U1 | 3/2005 |
| DE | 20 2007 003841 | U1 | 9/2007 |
| EP | 856233 | | 12/1960 |
| EP | 503559 | A1 | 9/1992 |
| EP | 618046 | A1 | 10/1994 |
| EP | 1693163 | | 2/2006 |
| EP | 01693163 | | 2/2006 |
| EP | 01777042 | | 4/2007 |
| FR | 787512 | | 9/1935 |
| JP | 55045442 | U | 3/1980 |
| JP | 57-13165 | | 1/1982 |
| JP | 61136778 | | 6/1986 |
| JP | 3-47775 | | 5/1991 |
| JP | 03103162 | | 10/1991 |
| JP | 429368 | | 3/1992 |
| JP | 5-31882 | | 4/1993 |
| JP | 0850512 | | 6/1996 |
| TW | I236402 | | 7/2005 |
| TW | M284496 | | 1/2006 |
| TW | M284500 | | 1/2006 |
| TW | M296765 | | 9/2006 |
| TW | I270445 | | 1/2007 |
| WO | 83/01406 | | 4/1983 |

(56) References Cited

FOREIGN PATENT DOCUMENTS

| | | | |
|---|---|---|---|
| WO | 9412322 | A1 | 6/1994 |
| WO | 9623631 | | 8/1996 |
| WO | 97/29887 | | 8/1997 |

* cited by examiner

DUAL PURPOSE FLIP-OUT AND T HANDLE

This Patent Application is a continuation application of the co-pending U.S. patent application Ser. No. 12/573,719 entitled DUAL PURPOSE FLIP-OUT AND T-HANDLE and filed on Oct. 5, 2009. The U.S. patent application Ser. No. 12/573,719 entitled DUAL PURPOSE FLIP-OUT AND T-HANDLE and filed on Oct. 5, 2009 is hereby incorporated by reference.

FIELD OF THE INVENTION

The present invention relates to hand tools. More specifically, the present invention relates to a dual purpose tool which is able to flip-out to form an L-handle and also form a T handle ratchet.

BACKGROUND OF THE INVENTION

T handle tools have a T-shaped body, including a long leg member and a short handle member. T handles usually have hexagonal-shaped tips for use with screws and other objects designed to accept a hexagonal tip. Once inserted, rotational pressure is applied to the hexagonal wrench in order to tighten or loosen the screw. The leg member and handle of the hexagonal wrench are designed to be in the shape of the letter "T" so that a user is able to grasp the handle with his hand(s) more comfortably.

T handle tools are manufactured and distributed in multiple English and metric sizes in order to facilitate their use with screw heads of multiple sizes. Such tools are usually sold in a set which includes tools of multiple sizes but are also distributed individually.

When using a T handle tool, a user will insert a leg end of the T handle tool onto the head of a workpiece such as a hexagonal screw, and will then exert rotational pressure using the handle on the handle end of the tool in order to tighten or loosen the screw. Due to the shape of the T handle tool it is particularly difficult to quickly turn a T handle tool because the user must constantly remove and replace his hand on the handle as it turns. Furthermore, the handle is usually not very easy to grip.

While the T handle tool is very helpful, there are instances due to space constrictions, that a T handle orientation is not usable and a modified orientation is needed for a hard to reach screw.

SUMMARY OF THE INVENTION

A dual purpose flip-out and T handle is able to be used in an L or modified L-handle orientation as well as a T handle orientation. The dual purpose flip-out and T handle includes a handle portion and a ratchet head and neck portion. The handle portion is coupled to the neck portion at a lockable hinge. The hinge allows the head and neck portion to rotate to an L or modified L-handle orientation or to a T handle orientation. When properly oriented the tool is able to be used to tighten or loosen objects such as screws or bolts.

In one aspect, a device comprises a first element and a second element with a ratchet mechanism, the second element coupled to the first element at a hinge, wherein the second element is configurable to a plurality of positions by movement around the hinge. The device further comprises a locking mechanism configured for locking the second element into the plurality of positions. The device further comprises an aperture within the first element, the aperture configured for receiving the ratchet mechanism of the second element. The plurality of positions include forming an L handle, a modified-L handle, a T handle and a modified-T handle. The modified-L handle forms an angle greater than 90° and less than 180° between the first element and the second element. The first element is configured to receive the second element when forming the T handle. The first element and the second element comprise rubber, plastic, metal or a combination thereof.

In another aspect, a device comprises a head and neck element including a head and a neck, a handle element including a body, an aperture within the body, the aperture configured for receiving the head and a slot within the body, the slot configured for receiving the neck, a lockable hinge for coupling the head and neck element and the handle element, the lockable hinge configured for allowing the head and neck element to move into a plurality of positions and maintaining a position of the plurality of positions and a ratchet mechanism contained within the head. The ratchet mechanism is removable. The plurality of positions include forming an L handle, a modified-L handle, a T handle and a modified-T handle. The modified-L handle forms an angle greater than 90° and less than 180° between the head and neck element and the handle element. The aperture is configured to receive the head when forming the T handle. The head and neck element and the handle element comprise rubber, plastic, metal or a combination thereof.

In yet another aspect, a method of manufacturing a device comprises forming a first element, forming a second element containing a ratchet mechanism and coupling the first element and the second element with a hinge, the second element configurable to a plurality of positions by movement around the hinge. The first element comprises a body, an aperture within the body, the aperture configured for receiving a head of the second element and a slot within the body, the slot configured for receiving a neck of the second element. The second element comprises a head and a neck. The hinge is lockable. The plurality of positions include forming an L handle, a modified-L handle, a T handle and a modified-T handle. The modified-L handle forms an angle greater than 90° and less than 180° between the first element and the second element. The first element is configured to receive the second element when forming the T handle. The first element and the second element comprise rubber, plastic, metal or a combination thereof.

DETAILED DESCRIPTION

A dual purpose flip-out and T handle enables a user to use the handle in an L or modified-L configuration and also a T or modified-T handle configuration providing a very versatile tool.

Figure 1:
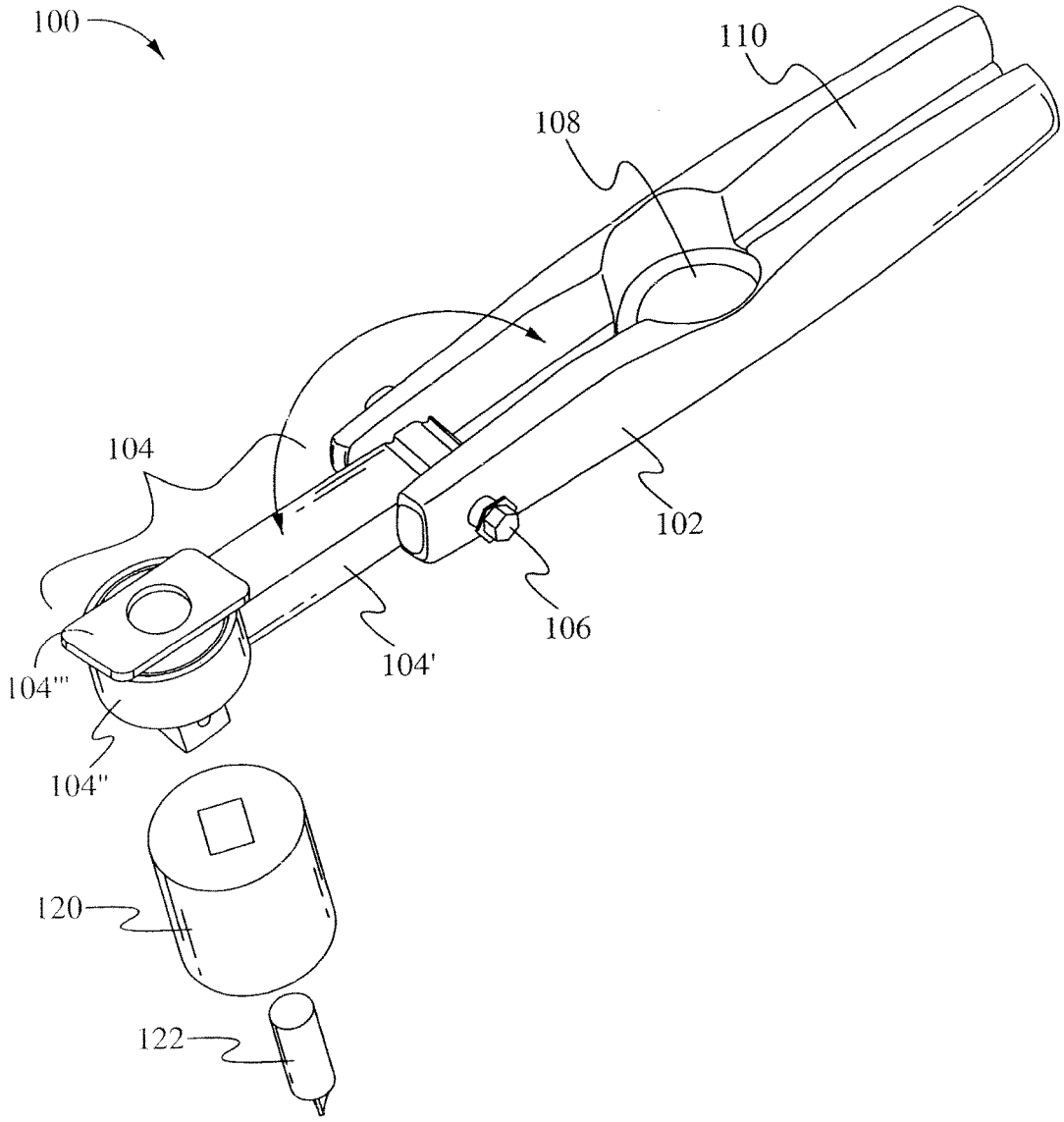
FIG. 1 illustrates a perspective view of a dual purpose flip-out and T handle in accordance with an embodiment of the invention.

FIG. 1 illustrates a perspective view of a dual purpose flip-out and T handle 100. The handle 100 includes a first element 102 also referred to as a handle portion and a second element 104 which includes a stem portion 104' and a head portion 104", the head portion 104" configured for receiving a drive 104'''. In some embodiments, the stem portion 104', the head portion 104" and the drive 104' are a single component, and in some embodiments, they are separate components. The first element 102 and the second element 104 are coupled to each other at a hinge 106. In some embodiments, the hinge 106 includes a locking mechanism. The locking mechanism is able to be any type of locking mechanism. In some embodiments, the first element 102 includes an aperture 108 for receiving the head portion 104" of the second element 104. In some embodiments, the first element 102 includes a slot 110 for receiving the stem portion 104' of the second element 104. The drive 104'''' is a ratchet mechanism. A drive 104'''' is able to be any size including but not limited to a ¼" drive and a ⅜" drive. In some embodiments, a connector device 120 couples to the drive 104'''' which then interfaces with a screw, bolt or other object. In some embodiments, the connector device 120 receives a tool 122 such as a screwdriver head which then interfaces with a screw or other object.

Figure 2:
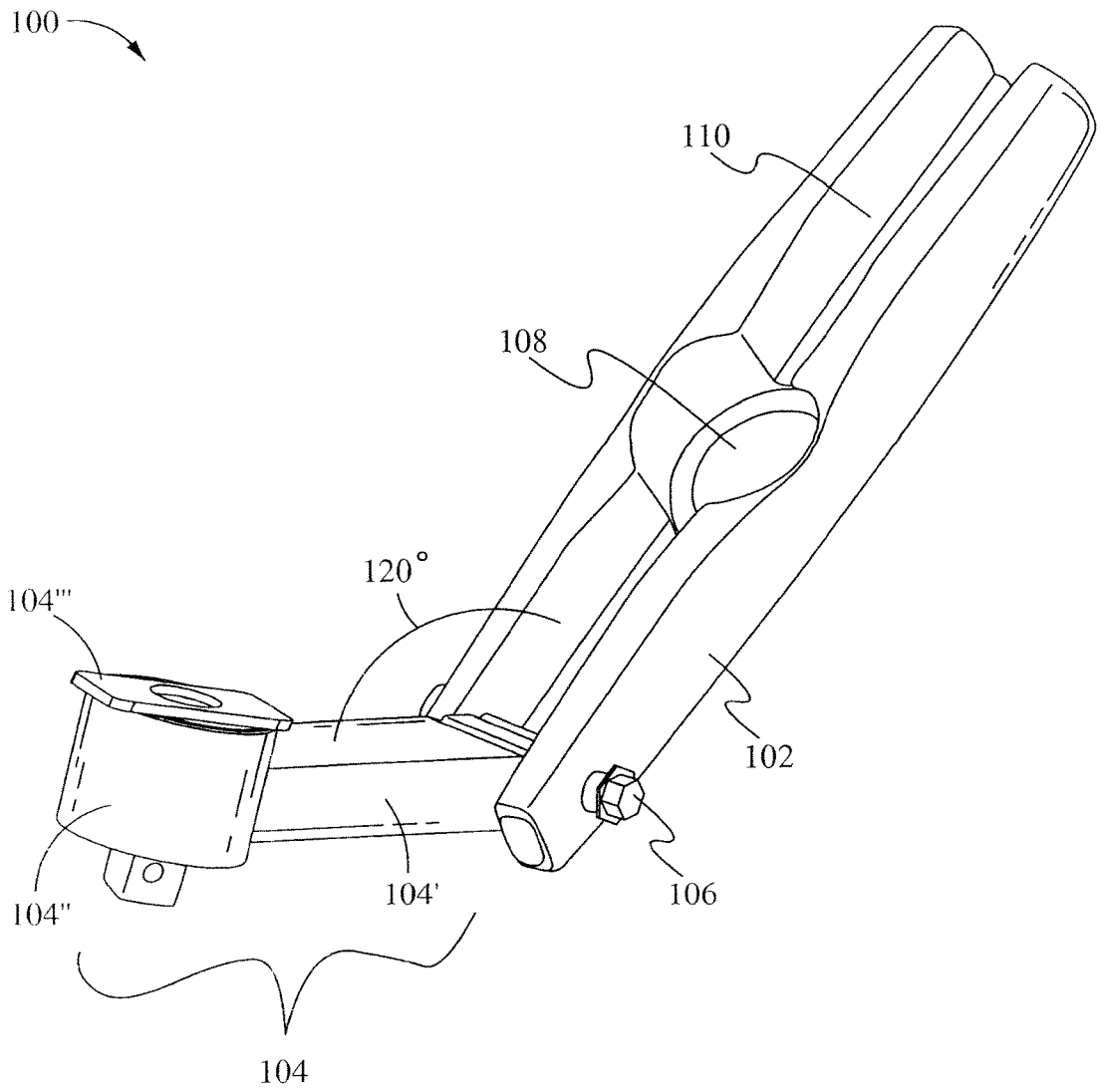
FIG. 2 illustrates a perspective view of the dual purpose flip-out and T handle configured in a modified-L position in accordance with an embodiment of the invention.

FIG. 2 illustrates a perspective view of the dual purpose flip-out and T handle 100 configured in a modified-L position. In an L position, the angle between the first element 102 and the second element 104 is 90°. In the modified L-position, the angle between the first element 102 and the second element 104 is greater than 90° and less than 180°. The handle 100 is able to reach 180° or more, but the closer the angle reaches to 180°, the more the handle 100 appears similar to a straight handle which is at 180°. By changing from a 180° straight handle to an L or modified-L position allows a user to tighten a nut, bolt or other object when a straight handle is not able to perform the task. For example, if a bolt is not easily accessible due to other objects nearby, a straight handle may not be able to reach the bolt; however, when configured appropriately, the handle 100 is able to reach the bolt. In some embodiments, the handle 100 is able to operate when configured at any angle.

Figure 3:
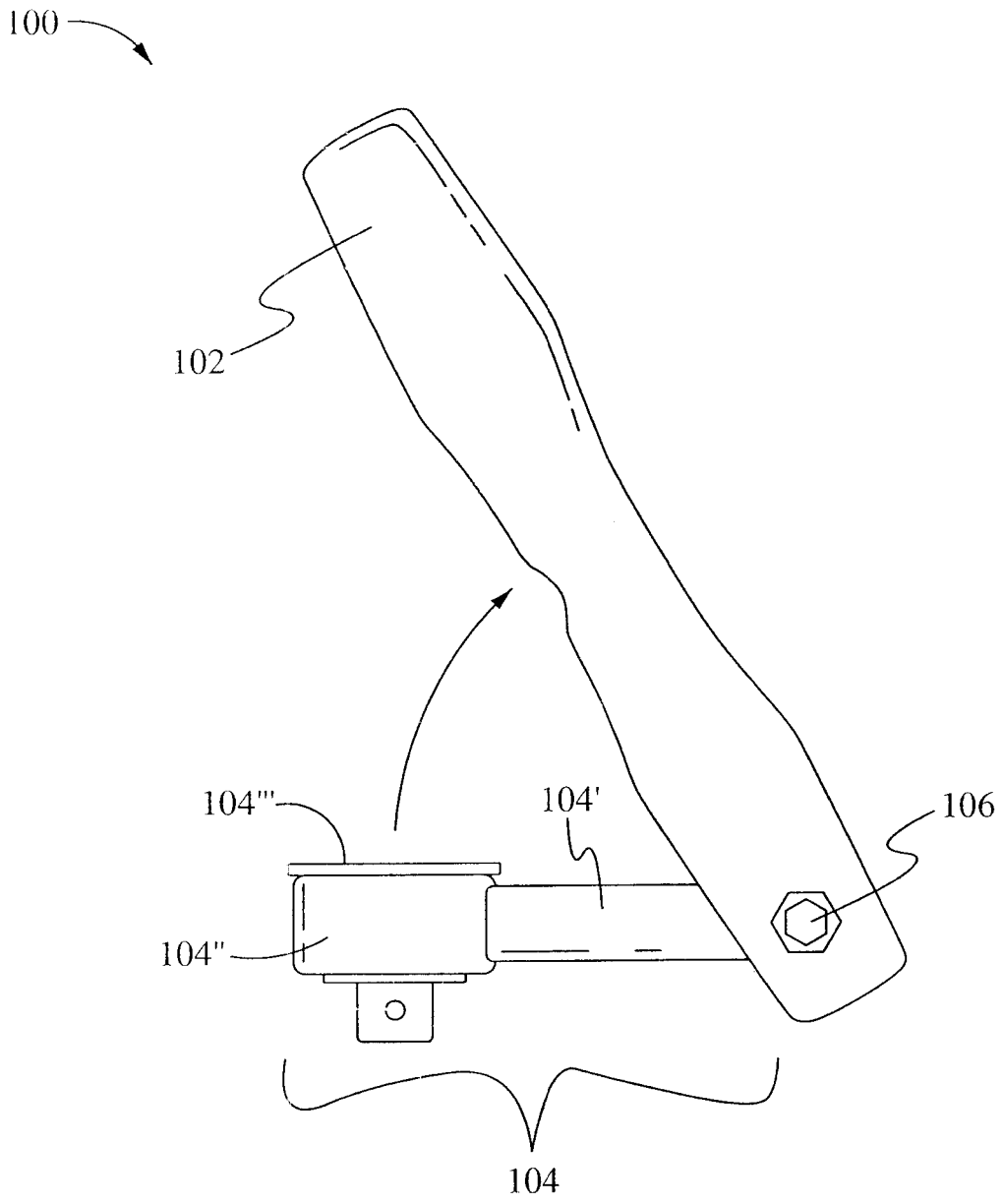
FIG. 3 illustrates a perspective view of the dual purpose flip-out and T handle in the process of being configured in the T position in accordance with an embodiment of the invention.

FIG. 3 illustrates a perspective view of the dual purpose flip-out and T handle 100 in the process of being configured in the T position. By moving (e.g. rotating) the first element 102 towards the second element 104, the handle 100 is able to be configured in a T position. The configuring is able to be performed with one hand.

Figure 4:
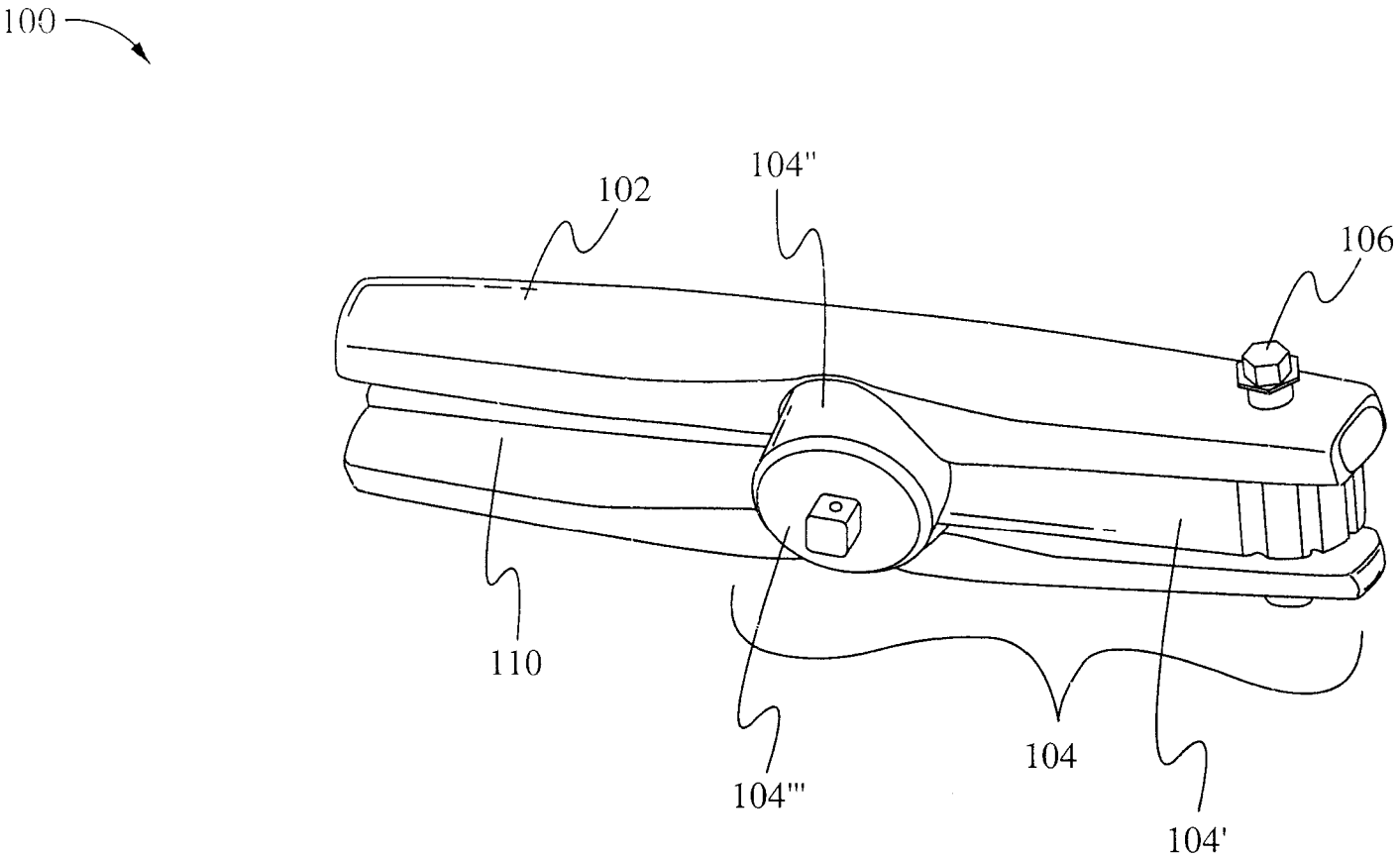
FIG. 4 illustrates a perspective view of the dual purpose flip-out and T handle configured in the T position in accordance with an embodiment of the invention.

FIG. 4 illustrates a perspective view of the dual purpose flip-out and T handle 100 configured in the T position. When in the T position, the second element 104 is positioned within the first element 102. In some embodiments, the head portion 104" of second element 104 is positioned within an aperture 108 of the first element 102, and the stem portion 104' of the second element 104 is positioned within a slot 110 of the first element 102. FIG. 4 illustrates the purpose of the aperture 108, as it allows the user to access the back of the driver 104'''' in order to facilitate drive reversal. In some embodiments, the first element 102 and the second element 104 form a T handle in a different manner, for example, without the use of an aperture and a slot.

Figure 5:
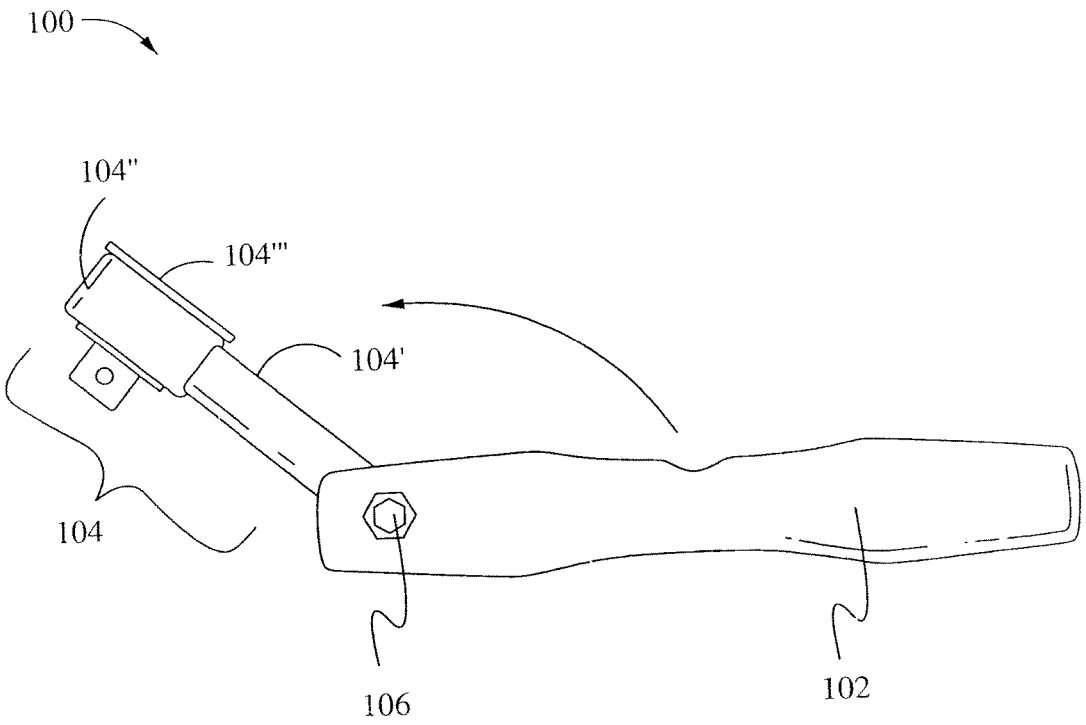
FIG. 5 illustrates a perspective view of the dual purpose flip-out and T handle folding out from the T position in accordance with an embodiment of the invention.

FIG. 5 illustrates a perspective view of the dual purpose flip-out and T handle 100 folding out from the T position. The second element 104 rotates around the hinge 106 in an outward motion to return to the straight configuration or an L/modified-L configuration.

Figure 6:
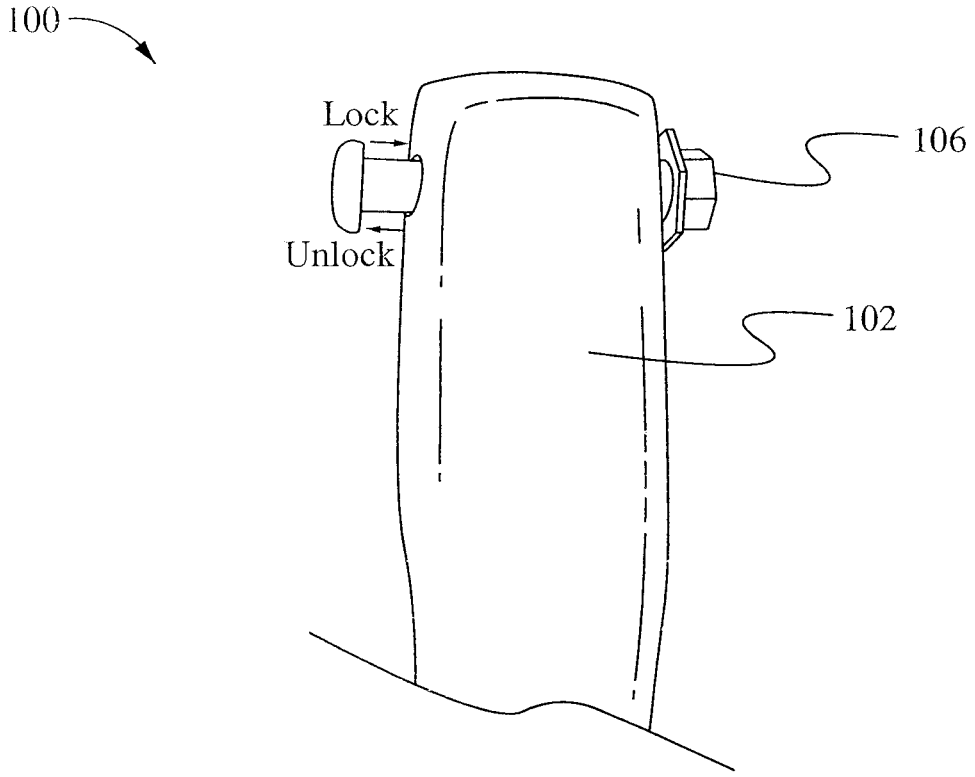
FIG. 6 illustrates a side view of the lockable hinge which is able to lock the handle in a desired configuration in accordance with an embodiment of the invention.

FIG. 6 illustrates a side view of the lockable hinge 106 which is able to lock the handle 100 in a desired configuration. In some embodiments, the lockable hinge 106 is a detent or a push/slide switch to lock the hinge 106. For example, if a user wants to lock the configuration of a 120° angle as shown in FIG. 2, the user is able to use the lockable hinge 106 to do so. The user is also able to lock the handle in the T configuration. To unlock the hinge 106, the user positions the lockable hinge 106 in an unlock position, such as by pushing the switch in the opposite direction.

Figure 7:
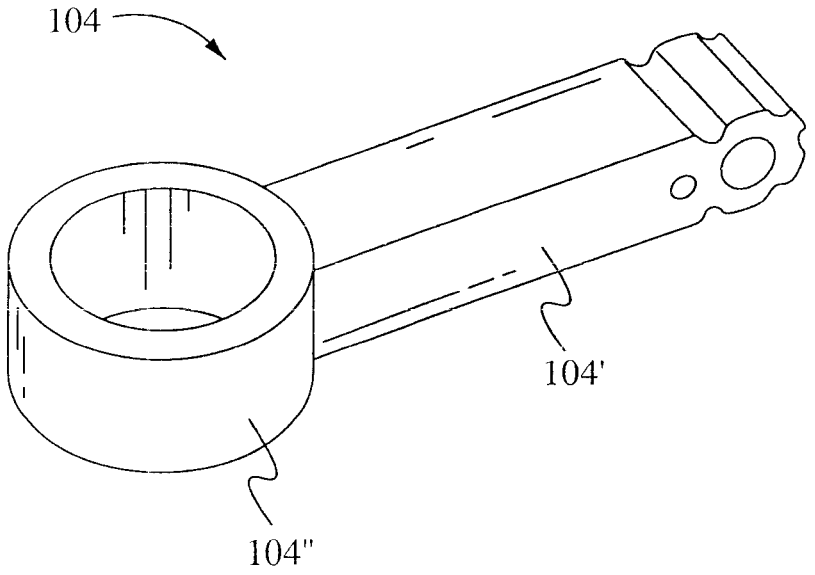
FIG. 7 illustrates a perspective view of a stem portion and head portion of a second element without a drive in the head portion in accordance with an embodiment of the invention.

FIG. 7 illustrates a perspective view of a stem portion 104' and head portion 104" of a second element 104 without a drive in the head portion 104". In some embodiments, the end of the stem portion 104' includes one or more apertures for receiving the hinge 106. In some embodiments, the end of the stem portion 104' includes ridges, grooves or another implementation to allow second element 104 to be configured at different positions such as 180°, 150°, 120° and 90°.

Figure 8A:
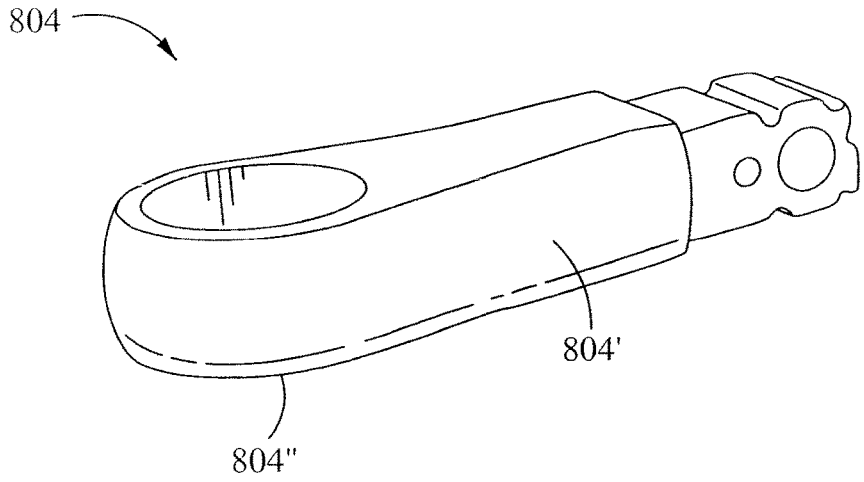
FIG. 8A illustrates a perspective view of a modified second element without a drive in accordance with an embodiment of the invention.

FIG. 8A illustrates a perspective view of a modified second element 804 without a drive. The modified second element 804 contains a stem portion 804' and a head portion 804". The stem portion 804' of the modified second element 804 includes a smoother transition to the head portion 804". Furthermore, the head portion 804" is more rounded.

Figure 8B:
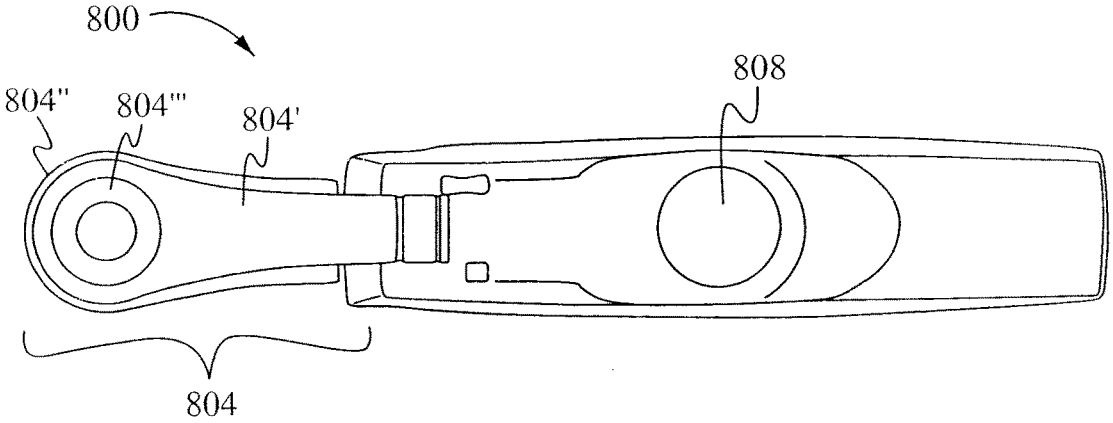
FIG. 8B illustrates a top view of a modified dual purpose flip-out and T handle in an open configuration in accordance with an embodiment of the invention.

FIG. 8B illustrates a top view of a modified dual purpose flip-out and T handle 800 in an open configuration. As described above, the modified second element 804 contains a stem portion 804' and a head portion 804". The stem portion 804' of the modified second element 804 includes a smoother transition to the head portion 804". Furthermore, the head portion 804" is more rounded. A handle portion 802 of the handle 800 includes an aperture 808 for receiving the head portion 804" of the modified second element 804. The handle portion 802 includes a receiving area (e.g. a depression) configured for receiving the stem portion 804'. A lockable hinge allows motion similar to the motion of the handle 100.

Figure 8C:
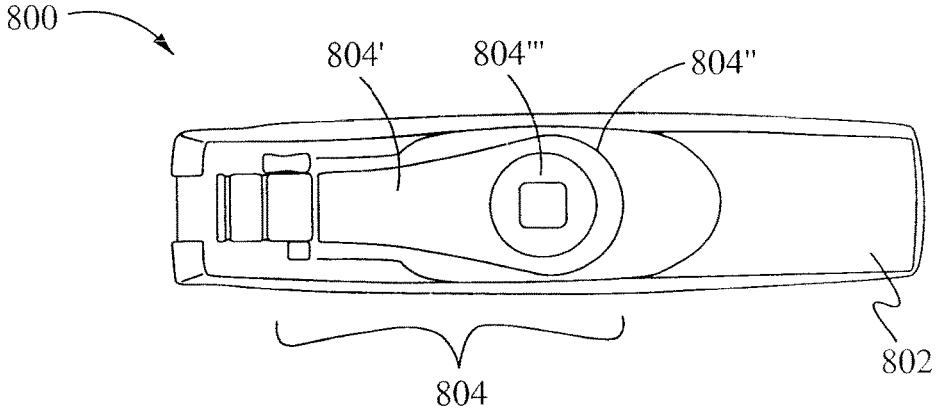
FIG. 8C illustrates a top view of a modified dual purpose flip-out and T handle in a closed or T configuration in accordance with an embodiment of the invention.

FIG. 8C illustrates a top view of a modified dual purpose flip-out and T handle 800 in a closed or T configuration. Similar to the handle 100, when configured appropriately, the handle 800 is able to form a T handle.

Figure 9:
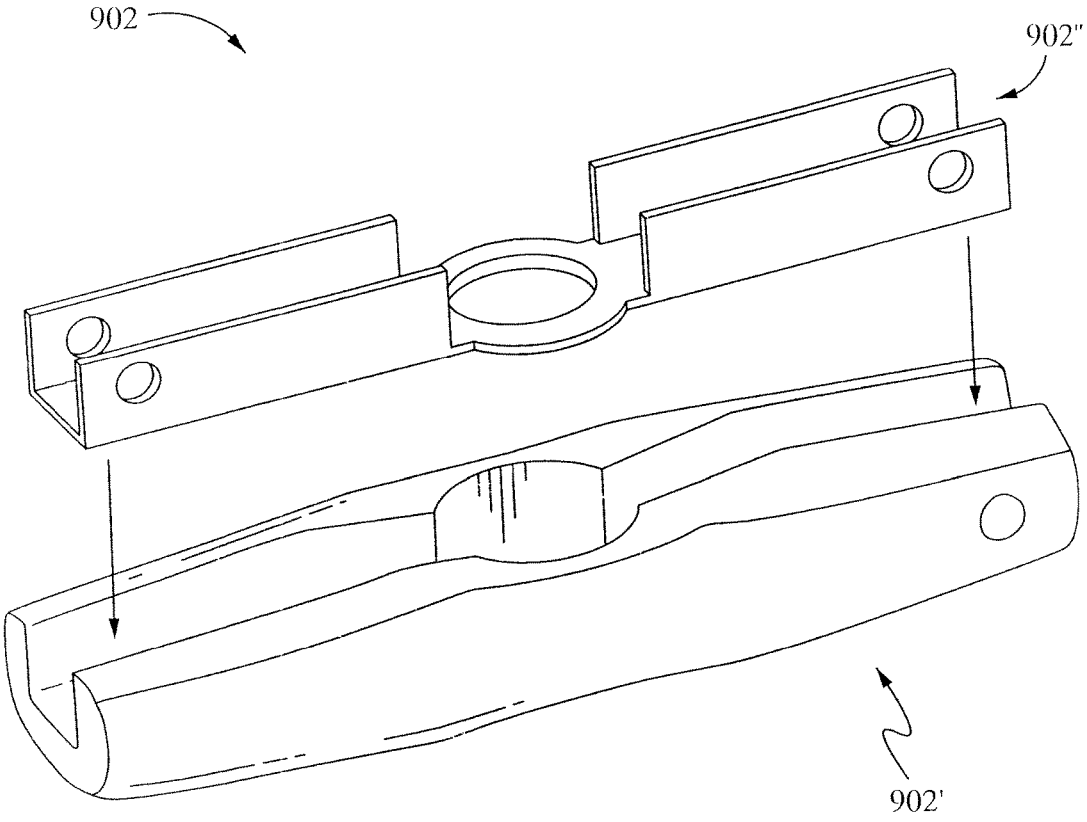
FIG. 9 illustrates a perspective view of a modified handle portion of the dual purpose flip-out and T handle in accordance with an embodiment of the invention.

FIG. 9 illustrates a perspective view of a modified handle portion 902 of the dual purpose flip-out and T handle. The handle portion 902 includes a bent steel substructure insert 902" which is inserted into an overmold 902'.

Figure 10:
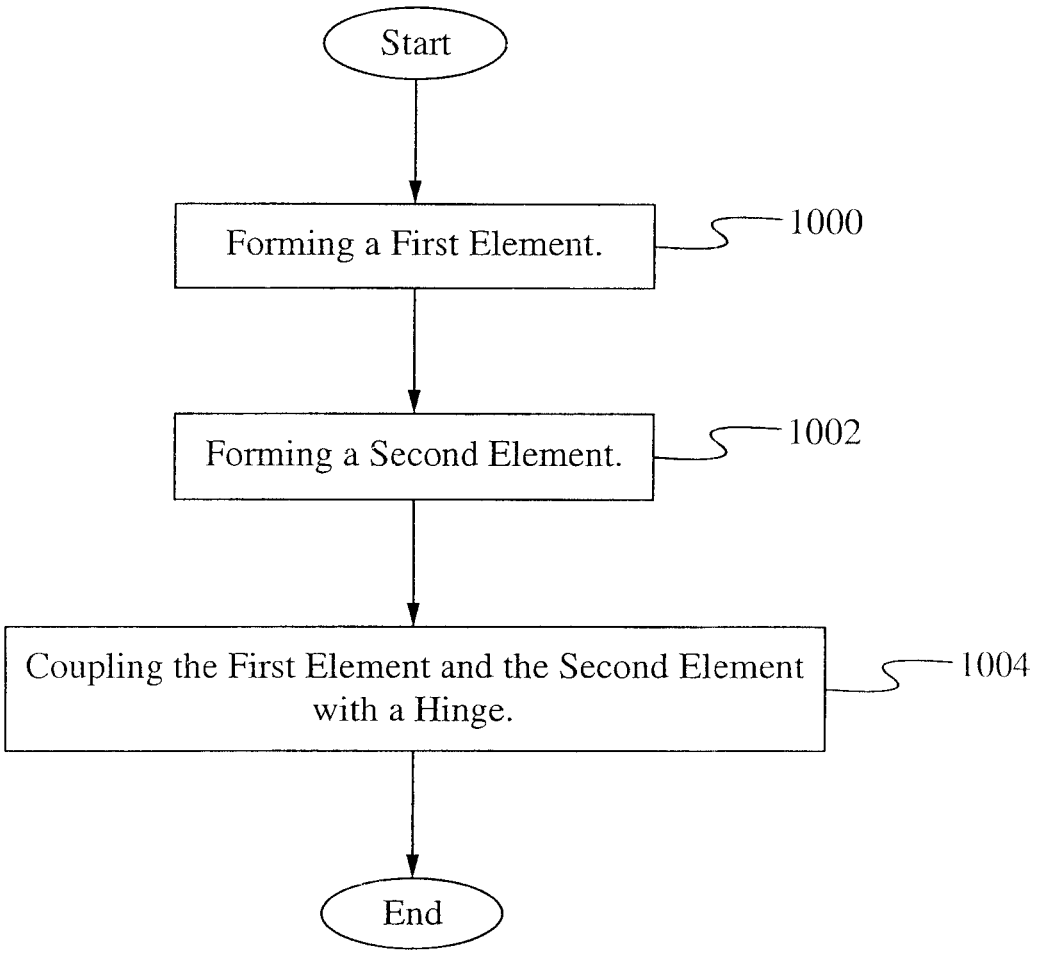
FIG. 10 illustrates a flowchart of a method of manufacturing the dual purpose flip-out and T handle in accordance with an embodiment of the invention.

FIG. 10 illustrates a flowchart of a method of manufacturing the dual purpose flip-out and T handle. In the step 1000, a first element is formed. In the step 1002, a second element is formed. In the step 1004, the first element and the second element are coupled with a hinge. The first element is configured to be hand-held and thus is sized accordingly. In some embodiments, the first element includes an aperture for receiving the head of the second element. In some embodiments, the first element includes a slot for receiving the stem of the second element. In some embodiments, the first element includes one or more holes for receiving the hinge. In some embodiments, the first element includes a receiving area for receiving the second element. In some embodiments, the first element is cast. In some embodiments, the first element is molded. In some embodiments, the first element includes a substructure insert which is inserted into an overmold. In some embodiments, the second element is one piece. In some embodiments, the second element is multiple pieces where the head section and stem section are separate components. In some embodiments, a drive is included within the head section. In some embodiments, a removable/replaceable drive is installed in the head. In some embodiments, the second element includes grooves, ridges or another implementation for aiding in locking into positions. In some embodiments, the order of the steps 1000 and 1002 is reversed or performed simultaneously. In some embodiments, the hinge is a lockable hinge.

The dual purpose flip-out and T handle is able to composed of any material. In some embodiments, the handle portion of the handle is a cast metal handle. In some embodiments, the handle is a durable plastic or rubber. In some embodiments, the handle is a combination of materials such as metal and rubber.

The dual purpose flip-out and T handle is able to be used with any type of device such as bolts, nuts, screws, and other devices with any type of drive type such as slotted, Phillips-head, hexagonal and others.

To utilize the dual purpose flip-out and T handle, a user initially configures the handle in a desired orientation. The user is able to configure the handle into an L, modified-L, T or modified-T configuration. Once in the desired orientation, the user is able to lock the handle into that configuration. The user uses the handle similarly to any other ratchet tool or T handle tool for tightening or loosening screws, nuts, bolts or other items.

In operation, the dual purpose flip-out and T handle, allows a user to reach items such as screws, nuts or bolts that are not able to be reached by standard tools. For example, if a screw is tucked away in a partially enclosed area, the handle is able to be modified into an L or a modified-L orientation to allow the user to reach the item with the handle and perform the desired task. Furthermore, the handle is able to be configured in a T handle orientation to provide a user with a better grip on the handle. The different configurations, L, modified-L, T and modified-T enable one handle to be able to used for many different tasks and reduces the number of tools required by a user.

The present invention has been described in terms of specific embodiments incorporating details to facilitate the understanding of the principles of construction and operation of the invention. Such reference herein to specific embodiments and details thereof is not intended to limit the scope of the claims appended hereto. It will be apparent to those skilled in the art that modifications can be made in the embodiment chosen for illustration without departing from the spirit and scope of the invention. Specifically, it will be apparent to one of ordinary skill in the art that the device and method of the present invention could be implemented in several different ways and have several different appearances.

We claim:

1. A device comprising:

a. a first element comprising an aperture and including a channel having a first side with a channel bottom on a first side of the aperture and a second side with a channel bottom on a second side of the aperture, wherein the second side of the channel defines a free and open end away from the aperture; and b. a second element comprising:

i. a ratchet mechanism; and ii. an elongated neck coupled between the ratchet mechanism and the first element at a lockable hinge;

wherein the second element is movable to a plurality of positions by movement around the lockable hinge, wherein the lockable hinge further comprises a locking mechanism for locking the second element into a selective one of the plurality of positions, and further wherein the first side of the channel receives the elongated neck, the aperture receives the ratchet mechanism and the second side of the channel extends beyond the aperture and ratchet mechanism when the second element is configured in one of the plurality of positions.

2. The device of claim 1 wherein the plurality of positions include forming an L handle, a modified-L handle, a T handle and a modified-T handle.

3. The device of claim 2 wherein the modified-L handle forms an angle greater than 90° and less than 180° between the first element and the second element.

4. The device of claim 2 wherein the first element is configured to receive the second element when forming the T handle.

5. The device of claim 1 wherein the first element and the second element comprise rubber, plastic, metal or a combination thereof.

6. A device comprising:

a. a head and neck element including:

i. a head; and ii. a neck;

b. a handle element including:

i. a body;

ii. an aperture within the body, the aperture configured for receiving the head; and iii. a channel having a first side with a channel bottom on a first side of the aperture and a second side with a channel bottom on a second side of the aperture and positioned along the surface of one side of the body, the channel configured for receiving the neck, wherein the second side of the channel extends beyond the aperture and the head, and further wherein the second side of the channel defines a free and open end away from the aperture;

c. a lockable hinge for coupling the head and neck element and the handle element, the lockable hinge comprising a locking mechanism allowing the head and neck element to move into a plurality of positions and locking the head and neck element into a selective position of the plurality of positions relative to the handle element; and d. a ratchet mechanism contained within the head.

7. The device of claim 6 wherein the ratchet mechanism is removable.

8. The device of claim 6 wherein the plurality of positions include forming an L handle, a modified-L handle, a T handle and a modified-T handle.

9. The device of claim 8 wherein the modified-L handle forms an angle greater than 90° and less than 180° between the head and neck element and the handle element.

10. The device of claim 8 wherein the aperture is configured to receive the head when forming the T handle.

11. The device of claim 6 wherein the head and neck element and the handle element comprise rubber, plastic, metal or a combination thereof.

12. A method of manufacturing a device comprising:

a. forming a first element comprising an aperture and including a channel having a first side with a channel bottom on a first side of the aperture and a second side with a channel bottom on a second side of the aperture, wherein the second side of the channel defines a free and open end away from the aperture;

b. forming a second element containing a ratchet mechanism and a neck coupled to the ratchet mechanism, wherein the channel is configured for receiving a head within the aperture and the neck within the first side of the channel and the second side of the channel extends beyond the aperture and the ratchet mechanism; and c. coupling the first element and the second element with a lockable hinge comprising a locking mechanism, the second element movable to a plurality of positions by movement around the lockable hinge, wherein the locking mechanism locks the second element into a selective one of the plurality of positions.

13. The method of claim 12 wherein the plurality of positions include forming an L handle, a modified-L handle, a T handle and a modified-T handle.

14. The method of claim 13 wherein the modified-L handle forms an angle greater than 90° and less than 180° between the first element and the second element.

15. The method of claim 13 wherein the first element is configured to receive the second element when forming the T handle.

16. The method of claim 12 wherein the first element and the second element comprise rubber, plastic, metal or a combination thereof.

* * * * *